US011213835B2

(12) United States Patent
Mickos

(10) Patent No.: US 11,213,835 B2
(45) Date of Patent: Jan. 4, 2022

(54) WATER-SAVING NOZZLE

(71) Applicant: Altered Stockholm AB, Stockholm (SE)

(72) Inventor: Kaj Verner Mickos, Nacka (SE)

(73) Assignee: Altered Stockholm AB, Stockholm (SE)

( * ) Notice: Subject to any disclaimer, the term of this patent is extended or adjusted under 35 U.S.C. 154(b) by 158 days.

(21) Appl. No.: 16/638,486

(22) PCT Filed: Mar. 27, 2019

(86) PCT No.: PCT/US2019/024186
§ 371 (c)(1),
(2) Date: Feb. 12, 2020

(87) PCT Pub. No.: WO2019/195043
PCT Pub. Date: Oct. 10, 2019

(65) Prior Publication Data

US 2020/0261929 A1 Aug. 20, 2020

Related U.S. Application Data

(60) Provisional application No. 62/651,519, filed on Apr. 2, 2018.

(51) Int. Cl.

| | |
|---|---|
| ***B05B 1/34*** | (2006.01) |
| ***B05B 1/12*** | (2006.01) |
| ***B05B 1/30*** | (2006.01) |
| ***B05B 1/06*** | (2006.01) |

(52) U.S. Cl.
CPC ..... *B05B 1/3489* (2013.01); *B05B 1/06* (2013.01); *B05B 1/12* (2013.01); *B05B 1/3066* (2013.01); *B05B 1/3415* (2013.01)

(58) Field of Classification Search
CPC .... B05B 1/06; B05B 1/12; B05B 1/18; B05B 1/185; B05B 1/3066; B05B 1/3415; B05B 1/3447; B05B 1/3468; B05B 1/3473; B05B 1/3489
USPC ..... 239/475, 487–489
See application file for complete search history.

(56) References Cited

U.S. PATENT DOCUMENTS 625,466 A * 5/1899 Randolph ..... B05B 1/3478 239/472
629,338 A * 7/1899 Chelimsky ..... F23D 11/10 239/404
1,118,118 A * 11/1914 Fischer ..... B05B 1/12 239/475
1,484,271 A * 2/1924 Murdock ..... C11D 13/22 510/445

(Continued)

*Primary Examiner* — Cody J Lieuwen
(74) *Attorney, Agent, or Firm* — Fasth Law Offices; Rolf Fasth

(57) ABSTRACT

The water-saving nozzle has an outer housing that includes an outer vortex screw in operative engagement with an inner housing that is disposed inside the outer housing. The vortex screw has helical threads. The inner housing has an inner vortex screw with outside helical threads. When water passes through the outer and inner vortex screws the water is rotated before the water passes into the vortex chambers of the inner and outer housings. The water discharged from the outer housing forms an outer dome shape and the water discharged from the inner housing forms an inner dome shape inside the outer dome shape.

9 Claims, 4 Drawing Sheets

(56) References Cited

U.S. PATENT DOCUMENTS 4,154,402 A * 5/1979 Fletcher ..... B05B 1/08
239/487
9,221,065 B1 * 12/2015 Renquist ..... B05B 1/3436

* cited by examiner

FIG. 2
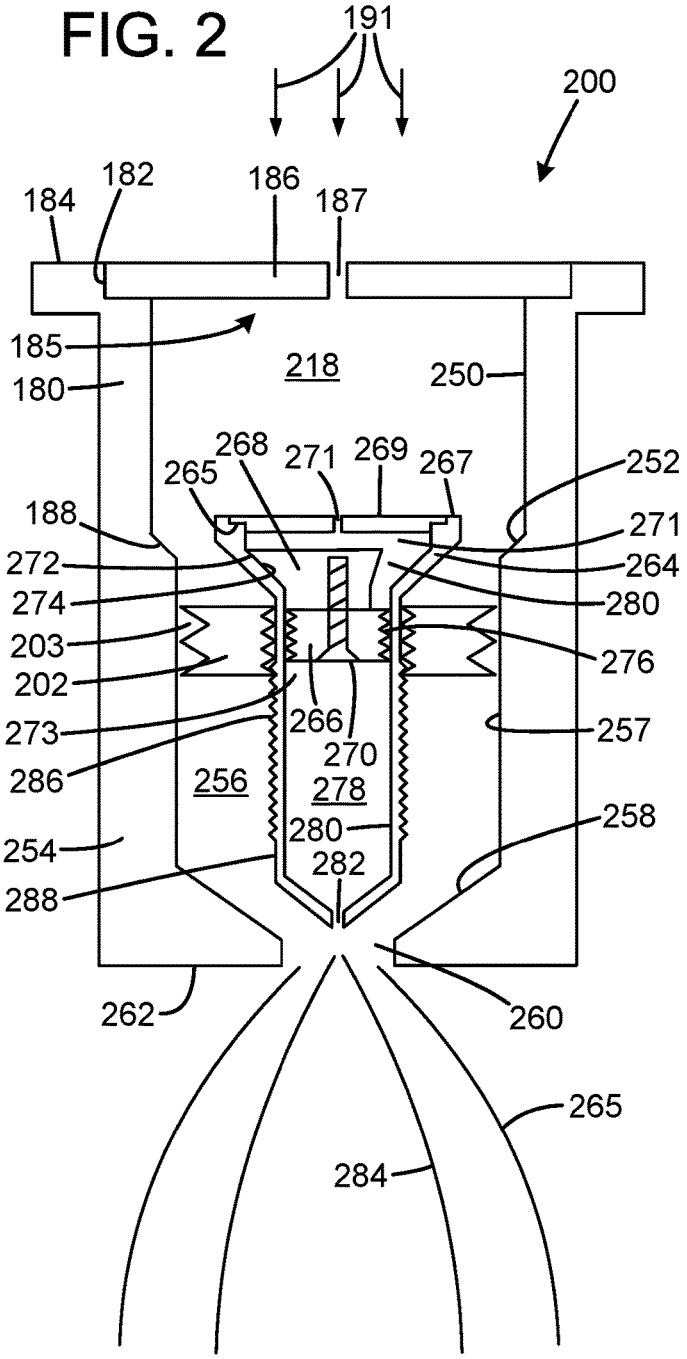
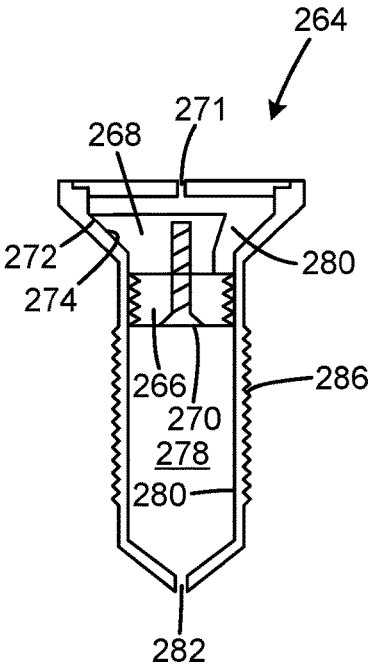
FIG. 3

FIG. 4a
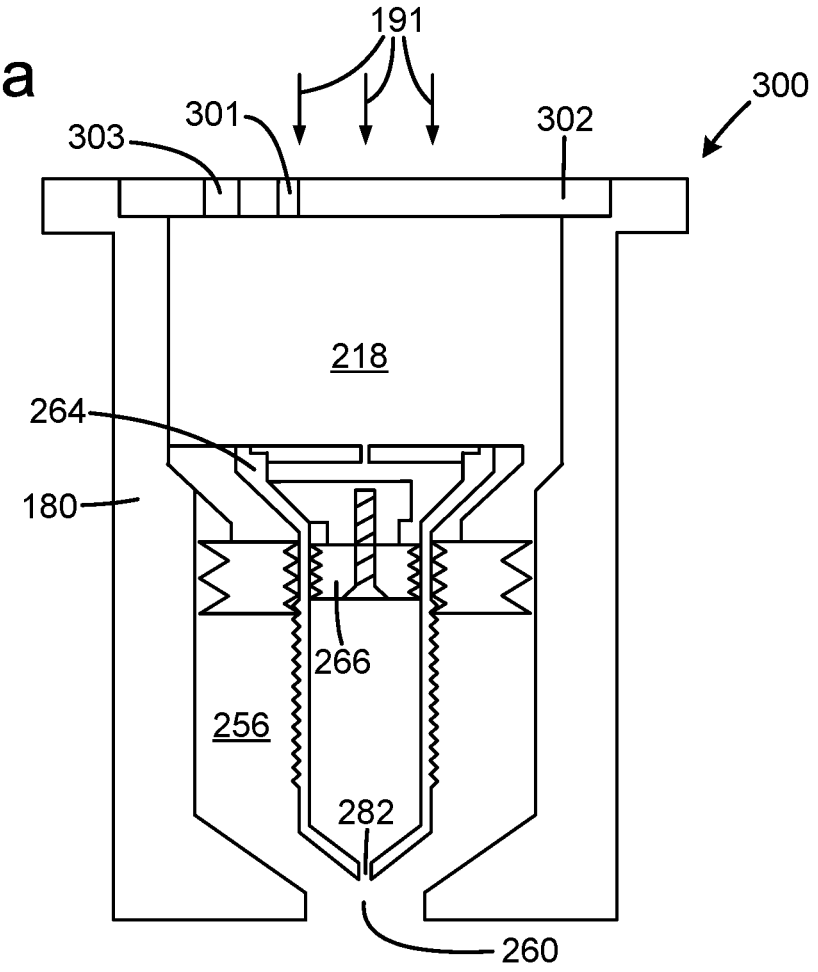
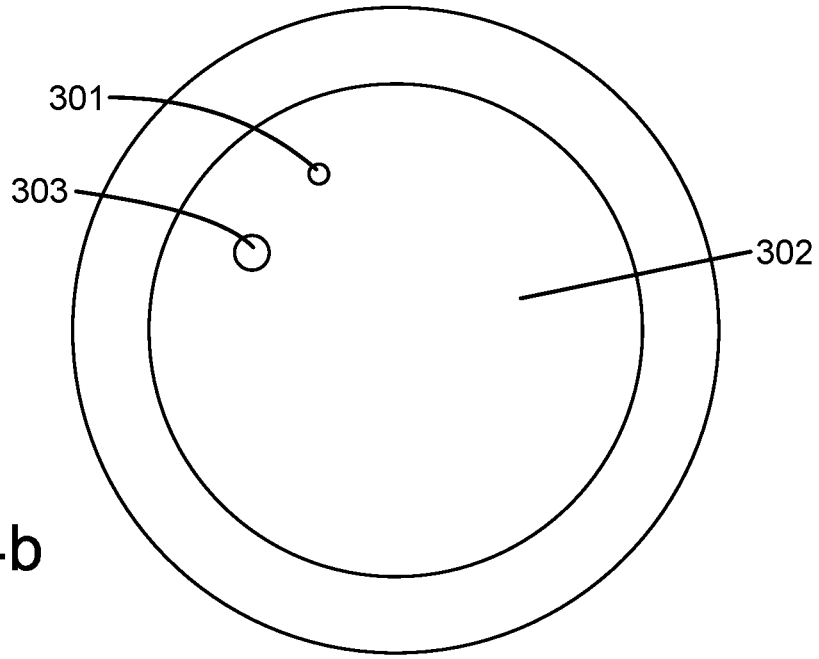
FIG. 4b

WATER-SAVING NOZZLE

PRIOR APPLICATION

This application is a U.S. national phase application based on International Application No. PCT/US19/24186, filed 27 Mar. 2019, claiming priority from U.S. Provisional Patent Application No. 62/651,519, filed 2 Apr. 2018.

TECHNICAL FIELD

The present invention relates to a nozzle that is mountable on a water source such as a shower or faucet to lower water-consumption and to clean the water.

BACKGROUND AND SUMMARY OF THE INVENTION

In many parts of the world, there is a tremendous need to reduce water consumption. Not only is the lack of water a problem but the low water quality and pressure of the available water are other equally important problems. Low water quality/pressure are often as big of a problem as the lack of available water because people often get seriously sick from drinking contaminated or unclean water. The water pressure is sometimes below 1 bar which makes it difficult to obtain a proper water flow. A primary object of the present invention is to present a nozzle that performs water saving functions despite low water pressure when water is discharged from a faucet, shower-head or the like while maintaining the water temperature. Another object is to present a nozzle that is very versatile and the type of water flow (dome-shaped water flow, mist or spray) can be tailored to the specific needs of the user. One drawback of using mist in showers is that the mist cannot retain the temperature as well and require a higher temperature of the incoming water. Another drawback is that the mist does not have a distinct direction and tend to flow in undesirable directions. The use of laminar water flows does not save enough water. The nozzle of the present invention overcomes these problems and drawbacks.

A further object of the present invention is that the nozzle according to the present invention is extremely simple but still robust in its design and function.

More particularly, the present invention is a method for discharging water through a water-saving nozzle that has an outer housing having an inlet opening, chamber and a discharge opening defined therein. An outer vortex screw is in operative engagement with an inner wall of the outer housing. The outer vortex screw has a central chamber defined therein. An inner housing is in operative engagement with the outer vortex screw inside the central chamber. The outer vortex screw has outside helical threads facing the inner wall. The outer housing has an outer vortex chamber defined therein below the vortex screw. The outer housing has a discharge opening defined at a bottom portion thereof. The inlet opening is in fluid communication with the chamber, the helical threads, the vortex chamber and the discharge opening so that water is flowable through the nozzle and dischargeable through the discharge opening in an outer dome shape. The inner housing has an inlet opening defined therein. The inner housing has an inner vortex screw in operative engagement with an inside wall. The vortex screw has outside helical threads facing the inside wall. The inner housing has an inner vortex chamber defined therein below the vortex screw. The inner housing has a discharge opening and the inlet opening in fluid communication with the chamber, the helical threads, the vortex chamber and discharge opening so that water is flowable through the nozzle and dischargeable through the discharge opening in an inner dome shape inside the outer dome shape.

The outer housing has a cone-shaped bottom portion that extends to the discharge opening.

The outer vortex screw is axially movable inside the outer housing.

The inner vortex screw is axially adjustable.

The inner vortex screw is in operative engagement with an upper part via a bolt and the inner vortex screw is movable relative to the inner housing and the upper part.

The outer housing has a first flow restrictor and the inner housing has a second flow restrictor.

The inner housing is axially adjustable relative to the outer housing.

The inner housing adjustable between a dome-shaped mode and a mist mode by axially adjusting the outer vortex screw and the inner vortex screw.

BRIEF DESCRIPTION OF THE DRAWINGS

A preferred embodiment of the nozzle according to the present invention will be described below, reference being made to the accompanying drawings where:

FIG. 2 is a cross-sectional view of an alternative embodiment of the nozzle of the present invention;

FIG. 3 is a cross-sectional detailed view of the inner housing of the nozzle shown in FIG. 2;

FIG. 4*a* is a cross-sectional view of yet an alternative embodiment of the nozzle of the present invention;

FIG. 4*b* is a top view of the embodiment shown in FIG. 4*a*; and

DETAILED DESCRIPTION

Figure 1A:
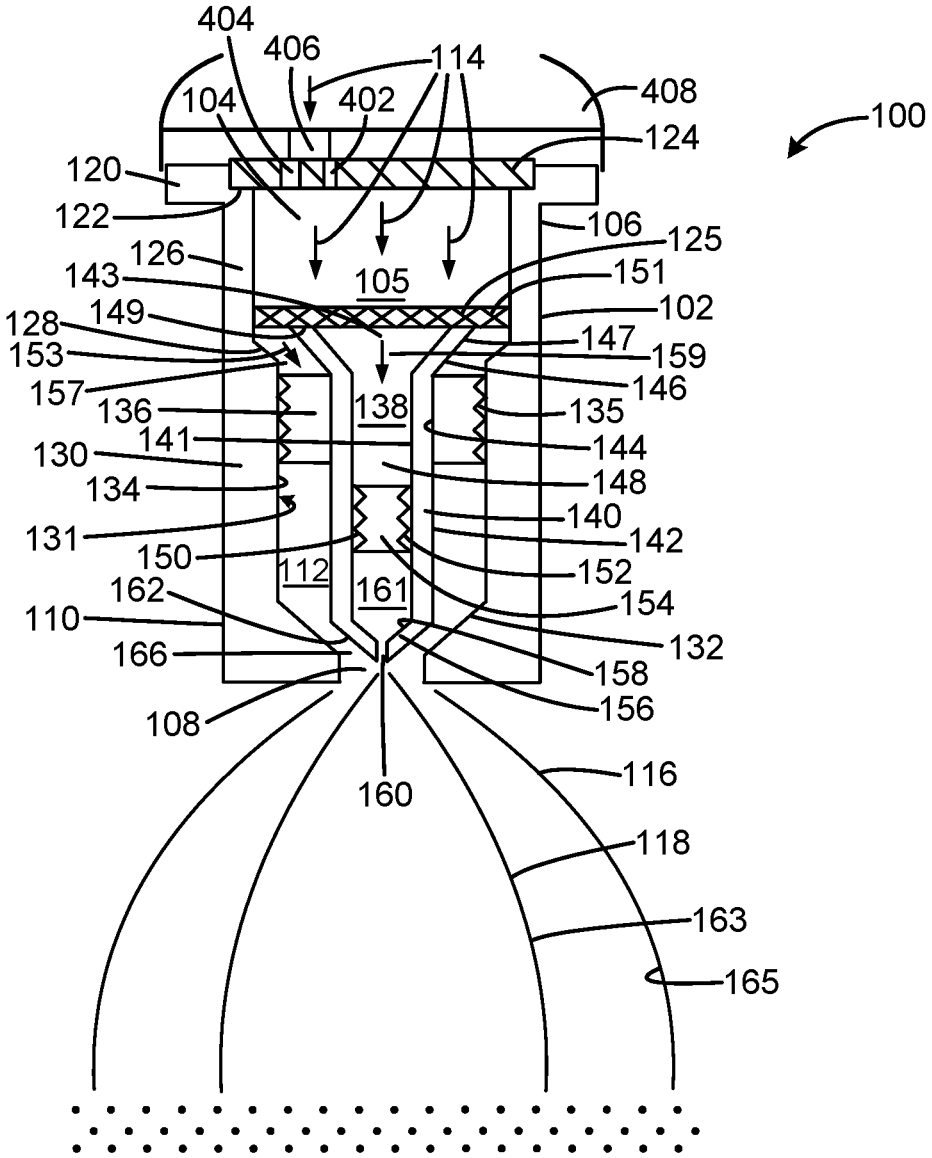
FIG. 1*a* is a cross-sectional view of the nozzle of the present invention when the inner housing of the nozzle is in dome mode.
Figure 1B:
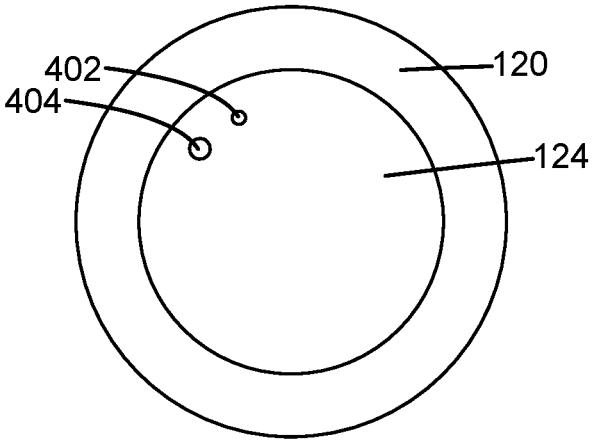
FIG. 1*b* is a top view of the embodiment shown in FIG. 1*a;*
Figure 5A:
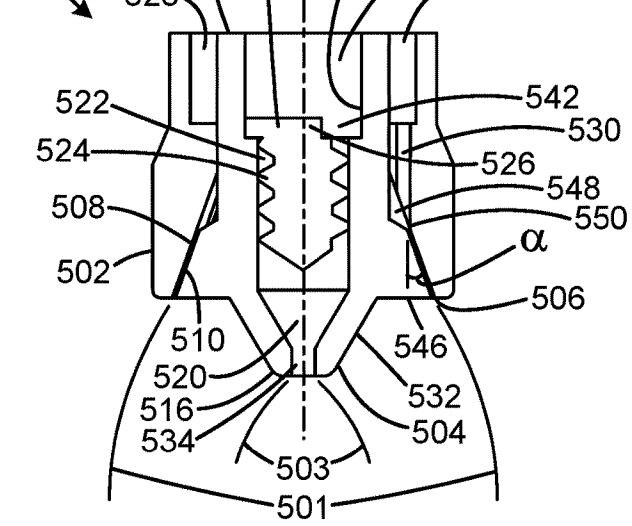
FIG. 5*a* is a cross-sectional side view of an alternative embodiment of the present invention.
Figure 5B:
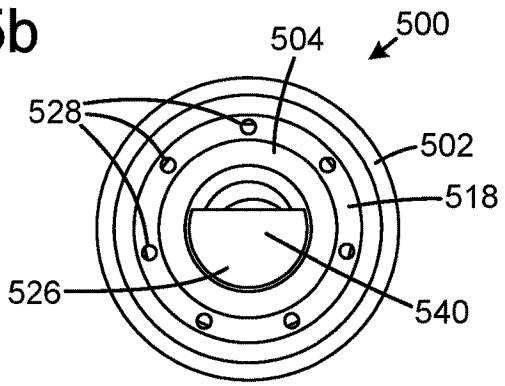
FIG. 5*b* is a top view of the embodiment shown in FIG. 5*a;*
Figure 5C:
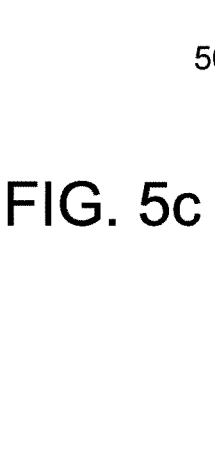
FIG. 5*c* is a side view of the embodiment shown in FIG. 5*a*.
Figure 5D:
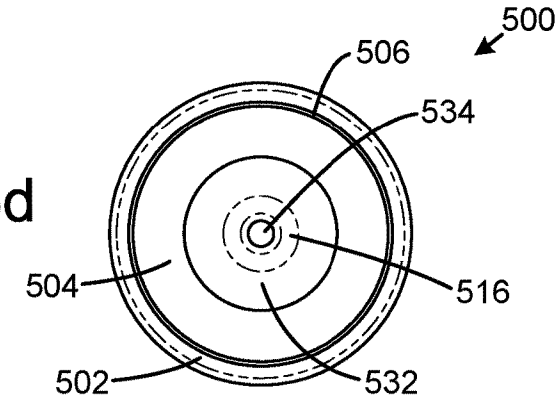
FIG. 5*d* is a bottom view of the embodiment shown in FIG. 5*c*.

With reference to FIGS. 1*a*-1*b*, the nozzle 100 of the present invention has a hollow cylindrical-shaped removable housing 102 that has an inflow opening 104 and a chamber 105 defined therein at an upper portion 106 and a discharge opening 108 defined therein at a bottom 110 of the housing 102. The housing 102 has an inner chamber 112 defined therein below chamber 105 so that fluids 114, such as water, is flowable (see arrows) from the inflow opening 104 through the chambers 105, 112 and out through the discharge opening 108. An important feature of the nozzle 100 is that when the water 114 is pressurized and flows through the nozzle 100, the discharged water forms a first hollow rotating dome shape 116 and a second hollow rotating dome shape 118 that is formed inside dome shape 116, as explained in more detail below. One important advantage of the present invention is that the dome shapes can be formed despite low water pressures (such as below 1 bar) so that it is possible to save water despite the low water pressure. The hollow dome-shaped water is particularly suitable for showers because the water drops retain the temperature and maintain the flow direction better than mist. Because the dome shapes 116, 118 are hollow, it is possible to combine the domes with mist or spray inside the domes so that the nozzle can be tailored to the specific needs of the user. There are many parameters that decide the hollow dome shape such as the water pressure, water flow, periphery velocity in the vortex chamber, thread pitch of the vortex screws, size of discharge openings, size of vortex chambers etc. The smaller the vortex chamber, the smaller is the dome radius of the rotating discharged water. In other words, by making the vortex chamber larger the radius of the dome may be increased. Also, the length of the discharge opening affects the specific shape of the dome. The longer the discharge opening the smaller is the radius of the dome. The area of the threads is another factor. For example, the large screw 136 requires a larger area of the thread (size of the thread channel and the pitch of the thread) compared to the small vortex screw 154 in order to create a dome-shaped discharge.

In general, the lower the water pressure the higher thread pitch is required. A flow restriction device 124 may be used to reduce the water flow into the nozzle 100. It may also be possible to use a higher pressure for the large screw 136 and a smaller pressure for the smaller screw 154 by using several flow restriction devices such devices 124, 125 so that the flow through screw 136 is higher than the flow through screw 154. The higher the pressure the wider radius of the dome so preferably the pressure through vortex screw 136 should be higher than the pressure through vortex screw 154. When the water pressure exceeds 3 bars, it is often necessary to use the above-mentioned flow restriction devices to reduce the pressure to about 1 bar at the helical screws because when the pressure is too high it is difficult to discharge the water so that it forms a dome-shape. When the discharge openings are too small, the water is discharged as super-spray which is similar to an uncontrollable and undesirable mist/spray. All the parameters must be in harmony in order to form the dome shapes.

More particularly, the upper portion 106 of housing 102 has a flange 120 that has an inner seat 122 defined therein to receive the flow restricting device 124 that reduce the flow of water 114 into the housing 102. The housing 102 has an upper large inner diameter section 126 that ends at a slanted section 128 that leads into the smaller inner diameter section 130 that defines the vortex chamber 112 i.e. the chamber formed below the vortex screw 136. The small inner diameter section 130 has a cone-shaped bottom portion 132 that has a surface terminates at the discharge opening 108. Section 130 may have a smooth inner wall 131 or a threaded section 134 that is adapted to threadedly hold helical outside threads 135 of the first rotatable helical hollow outer vortex screw 136. Preferably, the vortex screw 136 is fixedly secured to the housing 102 and a smooth inner wall 131 that does not have any threaded section. It may also be possible use a rotatable vortex screw 136. By rotating the screw 136 relative to the threaded section 134, the screw 136 is axially movable in an upward or downward direction inside the housing 102. In general, the water flow increases when the threads engage a shorter portion of the threaded section 134 because the threads slow down the velocity of the water. When the water pressure is low, it is advantageous to use a higher pitch of the thread of the screw 136.

The screw 136 has a central chamber 138 defined therein to receive an inner housing 140 having an inlet opening 143 defined therein. The inner housing 140 has an outer wall 142 attached to an inside surface 144 of the screw 136 in the chamber 138. Similar to the outer housing 102, the inner housing 140 is cylindrical and hollow so that the fluid 114 can flow through the inner housing 140. The housing 140 has a conical-shaped upper portion 146 that forms an upwardly directed funnel 147 for the incoming water 114 that flows through the chamber 105. The funnel 147 has an upper surface 149 that is located above the slanted surface 128 of the outer housing 102 inside inflow opening 104. A filter 151 rests upon the surface 149 to filter and remove contaminations from the incoming was 114. The filter 151 may be designed so that it also provides suitable flow restricting properties. The housing 140 has an inner elongate cavity 148 defined therein. The vortex screw 154 may be fixedly secured to a smooth inside wall 141 of the inner housing 140. The inner housing 140 may also have a threaded portion 150 that is adapted to threadedly receive outside threads 152 of the second rotatable helical inner vortex screw 154. Similar to screw 136, the screw 154 may thus be movable in the upward or downward direction by rotating the screw 154 relative to the threaded portion 150. The housing 140 has a conical-shaped bottom portion 156 with a slanted inner surface 158 that terminates at a second central discharge opening 160. The bottom portion 156 has an outside surface 162 that is also conical shaped. It is important that the bottom of the inside of the housings 102 and 140 are cone-shaped because the narrowing of the cone increases the velocity of the rotating water prior to being discharged prior through the discharge openings 108, 160, respectively.

The outside surface 162 of the inner housing 140 and an inner surface 164 of the cone-shaped bottom 132 of the outer housing 102 form a narrow channel 166. Preferably but not necessarily, the narrow channel 166 should have substantially parallel walls i.e. surfaces 162 and 164 should be substantially parallel.

In operation, the nozzle 100 is first properly mounted on a shower, faucet or the like. Water 114 first flows through restriction device 124 to reduce the pressure to a desirable amount. It may also be possible to operate nozzle 100 without the restriction device 124. When the water pressure is low, it is possible to use the nozzle 100 of the present invention without the pressure restricting device 124. The water 114 flows through the opening 104 and through filter 151 before entering chamber 105. The water is here divided into a first water stream 153 that flows into outer chamber 157 and a second stream 159 that flows into chamber 138 inside the inner housing 140. The first stream 153 flows through the helical threads 135 of the vortex screw 136 to create a rotation of the first water stream 153 before the stream 153 exits into the vortex chamber 112. The peripheral velocity of the rotating water stream 153 increases when the stream hits the conical shaped inner surface 132. The velocity increases as the surface 158 narrows before the rotating water stream 153 is discharged through opening 108 to form the hollow outer dome-shape 116. The parameters discussed above are set so that the dome shape 116 of the rotating water stream 153 is formed.

Similarly, water stream 159 flows through the vortex screw 154 to create a rotation of the water stream 159 increases in the inner vortex chamber 161 as the water stream 159 encounters the narrowing surface 158 before exiting the opening 160 so that the rotating water stream 159 forms the inner hollow dome 118. It is important that the parameters are set so that the outer surface 163 of dome 118 is smaller than the inner surface 165 of dome 116 so that there is no interference between the rotating dome 116 and 118. It is possible to design the threads of the screw 154 so that the rotational direction of stream 159 is opposite that of the stream 153. Preferably, the rotational direction of stream 153 and 159 should be the same.

Preferably, the flow restriction device 124 has a dome opening 402 and a boost opening 404 defined therein. The nozzle 100 is turned or rotated relative to the shower head 408, that has an inlet opening 406 defined therein, to align the inlet opening 406 with the openings 402, 404 to permit the water flow to flow through the dome opening 402 and/or the boost opening 404. By turning the nozzle in one direction, the user can gradually open the dome opening 402 and close boost opening 404 and by turning in the opposite direction the boost opening 404 is gradually opened while the dome opening is gradually closed. The water flow through the boost opening 404 is substantially higher than through the dome opening 402. When the water flows through the boost opening 404 no dome is, preferably, formed and the water essentially by-passes the flow restrictor 124. It is advantageous to use the boost opening 404 when the nozzle is used in, for example, a shower and the user is waiting for the temperature of the water to go from a cold temperature to a warm temperature when the shower is far away from the water heater. The openings 402, 404 should be placed so that one opening is gradually opened before the other opening is fully closed to prevent the water flow to stop which undesirably would increase the pressure in the water pipes and hoses. It should also be possible to select a middle position so that water passing through opening 406 partially flows through both openings 402, 404. FIG. 1*a* shows the opening 406 being aligned in the middle position.

With reference to FIGS. 2-3, the nozzle 200 is an alternative embodiment that is substantially similar to nozzle 100 except that nozzle 200 has an inner vortex screw that is divided into two-parts so that the size of the inner vortex chamber can be adjusted by moving the vortex screw upwardly or downwardly within housings. Nozzle 200 also has an outer vortex screw that may be moved upwardly or downwardly within the outer housing 180. More particularly, nozzle 200 has a hollow outer housing 180 that has a peripheral seat 182 defined therein at an upper surface 184 so that a filter or flow restrictor 186 can be seated therein. The outer housing 180 has an inlet opening 185 defined therein. The flow restrictor 186 has a central inlet opening 187 defined therein that leads into a cylindrical-shaped chamber 218, defined in the outer housing 180. The flow restrictor 186 reduces the flow of fluid such as water 191 flowing into the nozzle 200 (marked with arrows). The outer housing 180 has an upper inner wall 250 that ends at a lower chamfered section 252. A bottom portion 254 of the outer housing 180 has a lower inner wall 257 and a vortex chamber 256 defined therein.

A vortex screw 202 is disposed within the vortex chamber 256. The screw 202 has a central chamber 273 defined therein. The screw 202 has outside helical threads 203 that face the lower inner wall 257. The threads 203 form a helical-shaped pathway for the water to rotate the water prior to being discharged into the vortex chamber 256 below the vortex screw 202. In this way, the water 191 can flow into chamber 218, via inlet opening 187 and through the helical threads 203 to create or generate a rotation of the water that flows in the helical thread 203. The water passes through the threads 203 and continues rotating in the vortex chamber 256. At the bottom portion 254, the outer housing 180 has a conical-shaped inner wall 258 that terminates at an outlet opening 260 that is defined at a bottom or surface 262 of the nozzle 180. The rotational speed of the water increases when the water rotates against the inner wall 258 because the inner diameter is gradually reduced until the water is discharged through the outlet opening 260 as a hollow dome-shape form 265, as explained above regarding nozzle 100.

Similar to nozzle 100, nozzle 200 has an inner housing 264 that is substantially similar to inner housing 140 of nozzle 100. Only the main differences are here detailed. All other features are the same between inner housing 264 and inner housing 140. The inner housing 264 has a seat 265 defined therein at an upper surface 267 so that a removable second flow restrictor 269 can be seated therein. The flow restrictor 269 has a second inlet opening 271 defined therein to restrict the flow of water from the chamber 218 into a chamber 273 defined in the inner housing 264. It is to be understood that the restrictor 269 may be replaced by another restrictor that has a larger or smaller opening. Of course, the restrictor 269 may also be removed so that no restrictor is used. However, by using the flow restrictor 269 the water flow into the inner housing 264 (i.e. the flow rate) can be differentiated or made different from the flow of the water flowing into the chamber 218. This is important to make sure that suitable dome shapes are formed outside both the outer housing 180 and the inner housing 264 as water is discharge through both discharge openings 260, 282, as described in detail below. Too much water-flow through the inner housing 264 has tendency to create an undesirable super-spray (that is between spray and mist) especially when the discharge opening is also too large so that the super-spray is formed inside the outer dome shaped discharge 265. It is therefore important to adjust the size of the opening 271 of the restrictor 269 until the water ejected through opening 282 forms the dome shape 284 and not the undesirable super-spray.

The inner housing 264 has a two-part vortex screw 266 that has a conical upper part 268. The screw 266 is disposed in the central chamber 273 and in operative engagement with an inner wall 280 of the inner housing. The upper part 268 and the vortex screw 266 are held together by a rotatable bolt 270 that extends through the vortex screw 266 into the conical upper part 268. The upper part 268 has a slanted surface 272 that rests upon a slanted inner surface 274 of the inner housing 264. A flow channel 280 is formed between the slanted surface 272 and the inner surface 274 at one end of the upper part 268 to allow water 191 to flow from the chamber 218 through flow-channel 280 and into and through a threaded portion 276 of the vortex screw 266. Below the vortex screw 266, the inner housing 264 has an elongate cylindrical vortex chamber 278 defined therein. Preferably, the inner wall 280 of the vortex chamber 278 is smooth i.e. does not contain a threaded portion so that the vortex screw 266 can slide along the inner wall 280 when the position of screw 266 is adjusted by rotating bolt 270. At the bottom of vortex chamber 278, the inner housing 264 has a second discharge opening 282.

An important feature of nozzle 200 is, as indicated above, that the length of the vortex chamber 278 can be adjusted by rotating or turning the bolt 270 to move the vortex screw 266 away or towards the upper part 268 that rests on the inner wall 274 of the inner housing 264. When, for example, the vortex screw 266 is moved away from the upper part 268, the effective length of the vortex chamber 278 is shortened. The length of the vortex chamber 278 can thus be adjusted to compensate for variations in the water pressure, flow velocity and other factors to ensure that the discharged water through the second discharge opening 282 forms a second hollow dome shape 284 that is disposed inside the first hollow dome shape 265 generated in the outer housing 180.

In general, by making the chamber 278 too short or long the discharged fluid changes from a dome-shape to an irregular and undesirable spray. The rotational direction of the water inside the vortex chamber 278 may be the same or opposite direction compared to the rotational direction of the water inside vortex chamber 256. Also, it is possible to produce mist or spray (instead of the inner dome shape 284) inside the outside dome 265. For example, a restricting device may be used to reduce the size of the outlet discharge opening 282 in combination with a reduction of the vortex chamber 278 in order to create a suitable mist inside the outer dome 265.

The size or length of the vortex chamber 256 may also be adjusted by rotating the vortex screw 202 relative to an outside threaded portion 286 that is disposed on an outside wall 288 of the inner housing 264. In this way, the vortex screw 202 can be moved upwardly or downwardly to lengthen or shorten, respectively, the effective length of the vortex chamber 256.

It may also be possible to axially move the entire inner housing 264 relative to the outer housing 180 by rotating the inner housing 264 relative to the vortex screw 202 to take advantage of the threaded engagement between the threaded portion 286 of the inner housing 264 and the vortex screw 202. This is important because it makes it possible to move the position of the inner discharge opening 282 relative to the discharge opening 260 so that the inner dome 284 does not interfere with the outside dome 265. The discharge opening 282 may thus be axially moved from being located inside vortex chamber 256 to being inside discharge opening 260 and until the discharge opening 282 is located outside the discharge opening 260 and below the bottom surface 262 of housing 180. By changing the parameters described above, it is possible to change the form of the discharged water through opening 282 from the dome shape 284 to being discharged as spray and even as mist. This is also possible to do by adjusting the parameters of the outer housing 180.

With reference to FIGS. 4*a*-4*b*, the nozzle 300 is virtually identical to nozzle 200 except that nozzle 300 has a combined filter and flow restrictor 302 at the top of the nozzle 300. The filter and flow restrictor both filters and restrict the flow of water 191 into the nozzle 300. Preferably, the flow restriction device 302 has a dome opening 301 and a boost opening 303 defined therein that operates in the same way as dome opening 402 and boost opening 404 shown in FIG. 1*a*.

The nozzles may be made of a metal or plastics or a combination thereof. Instead of using threads on the housings, a suitable snap on mechanism could be used and components could be integrally made.

With reference to FIGS. 5*a*-5*d*, an alternative embodiment of a nozzle 500 is shown. The nozzle can be used to produce a hollow outer laminar dome 501, that is created by a laminar flow of the water, and a hollow inner rotating dome 503 that is created by water rotation in a vortex chamber similar to the creation of domes 116, 118, described in detail above. In other words, the ejected water form shapes that are dome-shaped. All the principles and details described regarding domes 116, 118 also apply to the inner dome 503 and are therefore not described here. Only the differences are described herein. One unique feature of nozzle 500 is that the inner and outer domes are created by using two different techniques. The laminar outer dome 501 has a continuous surface while the rotating inner dome does not have a continuous surface because it consists of micro-droplets.

The nozzle 500 has an outer cone 502 enclosing an inner cone or housing 504. The outer cone 502 and the housing 504 have an elongate, circular and narrow laminar flow slot 506 defined between a slanted inner surface 508 of the outer cone 502 and a slanted outer surface 510 of the housing 504 wherein the surfaces 508, 510 are substantially parallel.

An upper portion of the nozzle 500 has a plurality of inlet openings 528 defined therein. The water enters the inlet openings 528 and is forced through the slot 506 via channels 530 at high pressure to form the outer dome 501. The slot 506 is circular in shape and has a peripheral diameter that is greater than the peripheral diameter of the upper surface 518 at which the inlet openings 528 are located (best seen in FIGS. 5*a* and 5*b*). The slot 506 is directed at an angle alpha ($\alpha$) away from a longitudinal axis L. The angle alpha can vary between 10 degrees and 60 degrees but should preferably be about 20-50 degrees and most preferably about 35 degrees. It is possible to provide the nozzle 500 with an adjustment mechanism so that the size of the slot can be used i.e. to make the slot 506 narrower or wider. The inner cone 504 has an upper elongate chamber 512 defined therein that extends from an upper surface 514 to a bottom surface 516 at an orifice 534. The chamber 512 has a conical shaped vortex chamber 520 at a bottom of the chamber 512. A mid-section of the chamber 512 has an internal threaded section 522 that operatively engages outside threads 524 of a helical whirl or vortex screw 526. The upper surface 518 has a plurality of inlet openings 528 defined therein that are in fluid communication with the slot 506 via flow channels 530 so that water can enter the inlet openings 528 and flow via flow channels 530 out through the slot 506 that are at the outwardly directed angle ($\alpha$) so that the ejected water forms the hollow outer dome shape 501. Each inlet opening 528 extends into a flow channel 530.

The screw 526 has a cut-off head 540 so that an inlet 542 is defined between the head 540 and the inner wall 544 of chamber 512. The water enters the inlet 542 and is forced to rotate in the pathway of the threads 524, as explained in connection with nozzle 100, and into the vortex chamber 520 where the water spins before the water is ejected through opening 534 to create the rotating hollow inner dome 503. A circular intermediate peripheral chamber 548 is formed between the outer cone 502 and the inner cone 504 at the entrance 550 of the circular slot 506 so that the water flows from the flow channels 530 via the peripheral chamber 548 into the slot 506 that extends all the way around and between the inner cone 504 and outer cone 502.

The bottom surface 546 of the inner cone 504 has a conical shaped protrusion 532 that houses the vortex chamber 520. The protrusion 532 has the central orifice 534 defined therein that is in fluid communication with the vortex chamber 520. Preferably, the protrusion 532 extends beyond a bottom surface 546 so that the inner dome 503 does not interfere with the outer dome 501.

Instead of using a whirl screw 526 it is also possible to use a vortex disc that has at least two slanted openings defined therein at the periphery to force the water to pass through the disc at an angle to create a vortex below the disc. The vortex disc is particularly suitable when the water flow is high because the slanted openings can be enlarged.

While the present invention has been described in accordance with preferred compositions and embodiments, it is to be understood that certain substitutions and alterations may be made thereto without departing from the spirit and scope of the following claims.

I claim:

1. A water-saving nozzle, comprising:

an outer housing having an inlet opening and chamber and a first discharge opening defined therein;

an outer vortex screw in operative engagement with an inner wall of the outer housing, the outer vortex screw having a central chamber defined therein, an inner housing in operative engagement with the outer vortex screw inside the central chamber, the outer vortex screw having outside helical threads facing the inner wall;

the outer housing having an outer vortex chamber defined therein below the vortex screw;

the outer housing having the first discharge opening defined at a bottom portion thereof, the inlet opening being in fluid communication with the chamber of the outer housing, the helical threads, the vortex chamber and the first discharge opening so that water is flowable through the nozzle and dischargeable through the first discharge opening in an outer dome shape;

the inner housing having an inlet opening defined therein;

the inner housing having an inner vortex screw in operative engagement with an inside wall, the inner vortex screw having outside helical threads facing the inside wall; and the inner housing having an inner vortex chamber defined therein below the vortex screw;

the inner housing having a second discharge opening defined therein, the inlet opening being in fluid communication with the central chamber, the helical threads, the inner vortex chamber and the second discharge opening so that water is flowable through the nozzle and dischargeable through the second discharge opening in an inner dome shape inside the outer dome shape.

2. The water-saving nozzle according to claim 1, wherein the outer housing has a cone-shaped bottom portion that extends to the first discharge opening.

3. The water-saving nozzle according to claim 1, wherein the outer vortex screw is axially movable inside the outer housing.

4. The water-saving nozzle according to claim 1, wherein the inner vortex screw is axially adjustable.

5. The water-saving nozzle according to claim 1, wherein the inner vortex screw is in operative engagement with an upper part via a bolt, the inner vortex screw being movable relative to the inner housing and the upper part.

6. The water-saving nozzle according to claim 1, wherein the outer housing has a first flow restrictor and the inner housing has a second flow restrictor.

7. The water-saving nozzle according to claim 1, wherein the inner housing is axially adjustable relative to the outer housing.

8. The water-saving nozzle according to claim 1, wherein the inner housing is adjustable between a dome-shaped mode and a mist mode by axially adjusting the outer vortex screw and the inner vortex screw.

9. The water-saving nozzle according to claim 1, wherein the nozzle has an outer cone and an inner cone having an elongate slot defined therebetween to create an outer laminar dome.

* * * * *